US008845178B2

(12) United States Patent
Hanada et al.

(10) Patent No.: US 8,845,178 B2
(45) Date of Patent: Sep. 30, 2014

(54) IN-LINE-TYPE FLUID MIXER

(75) Inventors: Toshihiro Hanada, Nobeoka (JP); Shengli Li, Nobeoka (JP)

(73) Assignee: Asahi Organic Chemicals Industry Co., Ltd., Nobeoka-shi, Miyazaki (JP)

( * ) Notice: Subject to any disclaimer, the term of this patent is extended or adjusted under 35 U.S.C. 154(b) by 134 days.

(21) Appl. No.: 13/579,437

(22) PCT Filed: Feb. 22, 2011

(86) PCT No.: PCT/JP2011/054428

§ 371 (c)(1),
(2), (4) Date: Aug. 16, 2012

(87) PCT Pub. No.: WO2011/105596

PCT Pub. Date: Sep. 1, 2011

(65) Prior Publication Data

US 2012/0307588 A1 Dec. 6, 2012

(30) Foreign Application Priority Data

Feb. 23, 2010 (JP) ..... 2010-037593

(51) Int. Cl.
*B01F 5/04* (2006.01)
*B01F 3/08* (2006.01)
*B01F 5/00* (2006.01)

(52) U.S. Cl.
CPC ..... *B01F 3/0865* (2013.01); *B01F 2215/0036* (2013.01); *B01F 5/0413* (2013.01); *B01F 2005/0441* (2013.01); *B01F 5/043* (2013.01); *B01F 2005/0017* (2013.01); *B01F 2215/0034* (2013.01)
USPC ..... 366/163.2; 137/888

(58) Field of Classification Search
CPC ..... B01F 2005/0436; B01F 2005/0441; B01F 5/0413; B01F 5/0415
USPC ..... 366/163.2, 336; 137/888; 239/344
See application file for complete search history.

(56) References Cited

U.S. PATENT DOCUMENTS 3,271,304 A * 9/1966 Cox et al. ..... 210/621
4,026,817 A * 5/1977 Ciuti et al. ..... 516/53

(Continued)

FOREIGN PATENT DOCUMENTS

JP 61-187927 A 8/1986
JP 63-016037 A 1/1988

(Continued)

OTHER PUBLICATIONS

*International Search Report (PCT/ISA/210) issued on May 31, 2011, by the Japanese Patent Office as the International Searching Authority for International Application No. PCT/JP2011/054428.

*Primary Examiner* — Charles Cooley
*Assistant Examiner* — Marc C Howell
(74) *Attorney, Agent, or Firm* — Buchanan, Ingersoll & Rooney PC

(57) ABSTRACT

An in-line-type fluid mixer is provided, which includes a first channel-forming part defining a first inlet channel from a first inlet portion to a first passage portion; a second channel-forming part defining a second inlet channel from a second inlet portion to a second passage portion; a third channel-forming part defining an outlet channel having a sectional area that increases from a narrower portion through a flaring portion to an outlet portion, and being communicated with the first inlet channel and the second inlet channel, respectively, at an end of the narrow portion; and a whirling stream-generating part for generating a whirling stream in at least one of the first inlet channel and the second inlet channel.

4 Claims, 10 Drawing Sheets

(56) References Cited

U.S. PATENT DOCUMENTS

| | | | | |
|---|---|---|---|---|
| 4,123,800 | A * | 10/1978 | Mazzei | 366/163.2 |
| 5,426,137 | A | 6/1995 | Allen | |
| 5,863,128 | A * | 1/1999 | Mazzei | 366/163.2 |
| 6,030,586 | A | 2/2000 | Kuan | |
| 6,427,435 | B1 | 8/2002 | Patterson et al. | |
| 6,994,276 | B2 | 2/2006 | Faye et al. | |
| 8,033,714 | B2 * | 10/2011 | Nishioka et al. | 366/163.2 |
| 2005/0111298 | A1 * | 5/2005 | Lott | 366/163.2 |
| 2006/0127827 | A1 | 6/2006 | Yoshida et al. | |
| 2008/0073444 | A1 | 3/2008 | Blechschmitt et al. | |
| 2008/0267006 | A1 * | 10/2008 | Moreira Campos | 366/165.1 |
| 2010/0142312 | A1 | 6/2010 | Imai | |
| 2010/0170248 | A1 | 7/2010 | Yoshida et al. | |

FOREIGN PATENT DOCUMENTS

| | | | |
|---|---|---|---|
| JP | 63-051927 | A | 3/1988 |
| JP | 4-53437 | U | 5/1992 |
| JP | 08-229376 | A | 9/1996 |
| JP | 2002-071134 | A | 3/2002 |
| JP | 2004-089968 | A | 3/2004 |
| JP | 2006-102711 | A | 4/2006 |
| JP | 2006-105488 | A | 4/2006 |
| JP | 2006-247619 | A | 9/2006 |
| JP | 2007-117799 | A | 5/2007 |
| JP | 2009-154049 | A | 7/2009 |
| JP | 2010-504194 | A | 2/2010 |

* cited by examiner

IN-LINE-TYPE FLUID MIXER

TECHNICAL FIELD

This invention relates to a fluid mixer used for fluid transport piping in a variety of industries such as chemical plants or in the field of semiconductor production, in the field of foods, in the field of medicine, in the field of biotechnology, etc. Specifically, the invention relates to an in-line-type fluid mixer capable of mixing and homogeneously stirring a plurality of fluids in a pipeline.

BACKGROUND ART

In order to mix a plurality of fluids together in-line, there has heretofore been employed a method by making use of a Venturi tube which, as shown in FIG. 13, has a narrowing channel forming a contracting portion 104, a throat portion 105 and a flaring portion 106 in a continuing manner. In FIG. 13, a primary fluid flows in through an inlet channel 101, passes through the contracting portion 104, throat portion 105 and flaring portion 106 in this order, and flows into an outlet channel 103. In this case, the throat portion 105 is designed to have a sectional area smaller than the sectional areas of the inlet channel 101 and the outlet channel 103. Therefore, the fluid flows through the throat portion 105 at an increased velocity, producing a negative pressure in the throat portion 105. As a result, a secondary fluid is sucked from a suction channel 102 communicated with the vicinity of the throat portion 105 due to the negative pressure, mixed into the primary fluid and flows out through the outlet channel 103. Thus, such an in-line-type fluid mixer has an advantage in that no special device such as a pump is necessary for injecting the secondary fluid.

In the above fluid mixer, however, the fluid to be sucked joins the flow from a direction deviated in the circumferential direction from the suction channel 102 communicated with the inner circumference of the throat portion 105. Therefore, the fluids tend to be inhomogeneously mixed together in the channel. In order to avoid inhomogeneous mixing and to more homogeneously mix and stir the fluids, it is necessary to install a stationary mixer or the like in the downstream of the in-line fluid mixer.

To solve the above problem, a liquid mixer using a jet nozzle as shown in FIG. 14 has been proposed (see JP 2009-154049 A). In this liquid mixer, a raw water passage 107 is provided with an ejector 109 for ejecting a chemical solution fed from a chemical solution introduction pump 108 and a mixer 110 in the downstream of the ejector 109. Further, in the immediate downstream of a nozzle member 111 of the ejector 109, there is a negative pressure-generating space 113 having a sectional area larger than that of a jet 112 of the nozzle member 111. The raw water is introduced from the raw water passage 107 into an inner passage 114 of the nozzle member 111 and is injected from the jet 112, whereby a negative pressure is generated in the negative pressure-generating space 113 and the chemical solution is introduced from an introduction communication passage 115.

By using the above ejector 109, the chemical solution flowing in from the introduction communication passage 115 is mixed into the raw water from the entire circumferential directions along an outer wall 116 of the nozzle member 111. Therefore, the chemical solution can be mixed more homogeneously than when it is mixed by the mixing method using the conventional Venturi tube.

SUMMARY OF THE INVENTION

In the above-mentioned conventional liquid mixer, however, the flow of the chemical solution flowing in through the introduction communication passage 115 tends to deviate to the negative pressure-generating space 113 through a path forming the shortest route in the outer circumference of the outer wall 116 of the nozzle member 111. Namely, the chemical solution tends not to flow into the negative pressure-generating space 113 from the lower side in FIG. 14. Accordingly, the raw water and the chemical solution cannot be sufficiently homogeneously mixed together, causing inhomogeneity. In order to avoid inhomogeneous mixing, a stationary mixer or the like must be installed in the downstream of the ejector 109. This complicates the apparatus as a whole, resulting in an increased cost for producing the apparatus.

It is, on the other hand, possible to enhance the mixing effect by further decreasing the sectional area of the jet 112 of the nozzle member 111 and increasing the velocity of raw water injection. However, as the velocity of flow of the raw water reaches a predetermined value, cavitation may occur, causing damages to the inner wall of the pipe in the downstream of the ejector 109.

The object of the present invention is to provide an in-line-type fluid mixer which is capable of homogeneously mixing a plurality of fluids together and of preventing the inner wall of the pipe from being damaged even in the conditions where the cavitation may occur.

In order to achieve the above object according to the present invention, an in-line-type fluid mixer is provided, the fluid mixer comprising: a first channel-forming part having a first inlet portion and a first passage portion extending in a lengthwise direction, the first channel-forming part defining a first inlet channel from the first inlet portion and over the first passage portion; a second channel-forming part having a second inlet portion and a second passage portion extending along a tapered surface that surrounds a periphery of the first passage portion, the second channel-forming part defining a second inlet channel from the second inlet portion and over the second passage portion; a third channel-forming part having a narrower portion, a flaring portion and an outlet portion, the third channel-forming part defining an outlet channel having a sectional area that increases from the narrower portion through the flaring portion to the outlet portion and being communicated with the first inlet channel and the second inlet channel, respectively, at an end of the narrower portion; and a whirling stream-generating part for generating a whirling stream in at least one of the first inlet channel and the second inlet channel.

MODES FOR CARRYING OUT THE INVENTION

First Embodiment

Figure 1:
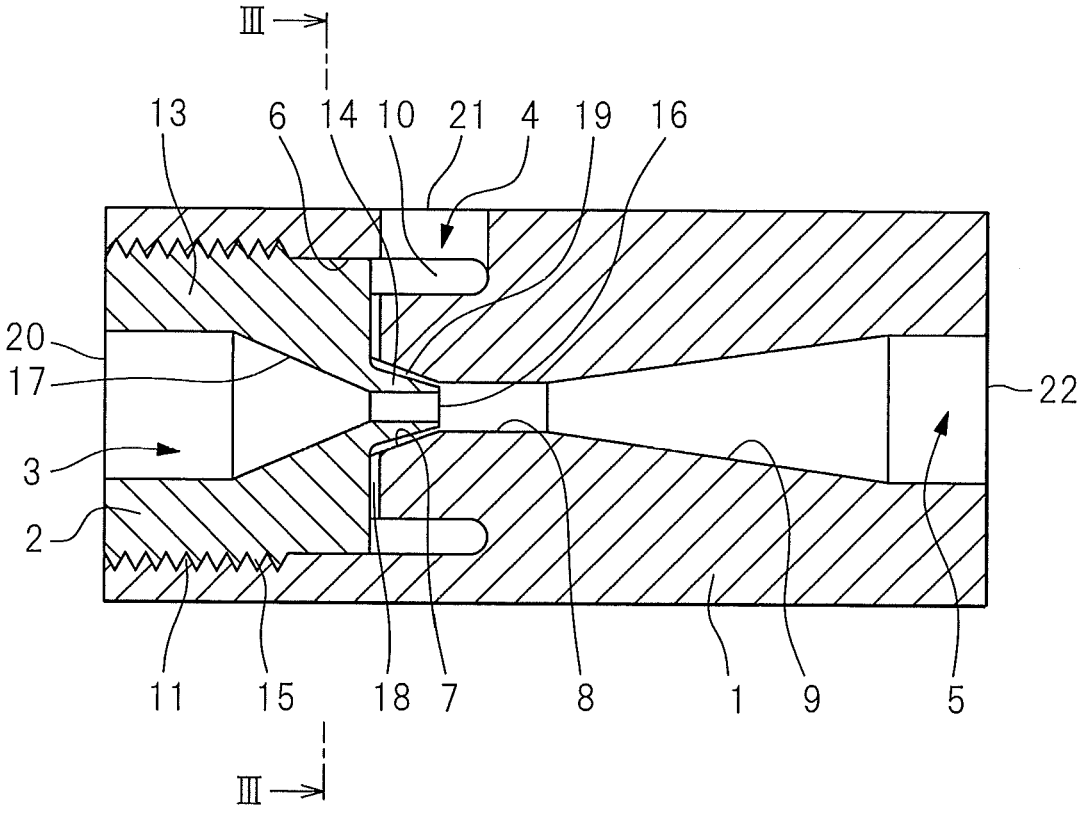
FIG. 1 is a lengthwise sectional view showing an in-line-type fluid mixer according to a first embodiment of the invention.
Figure 2:
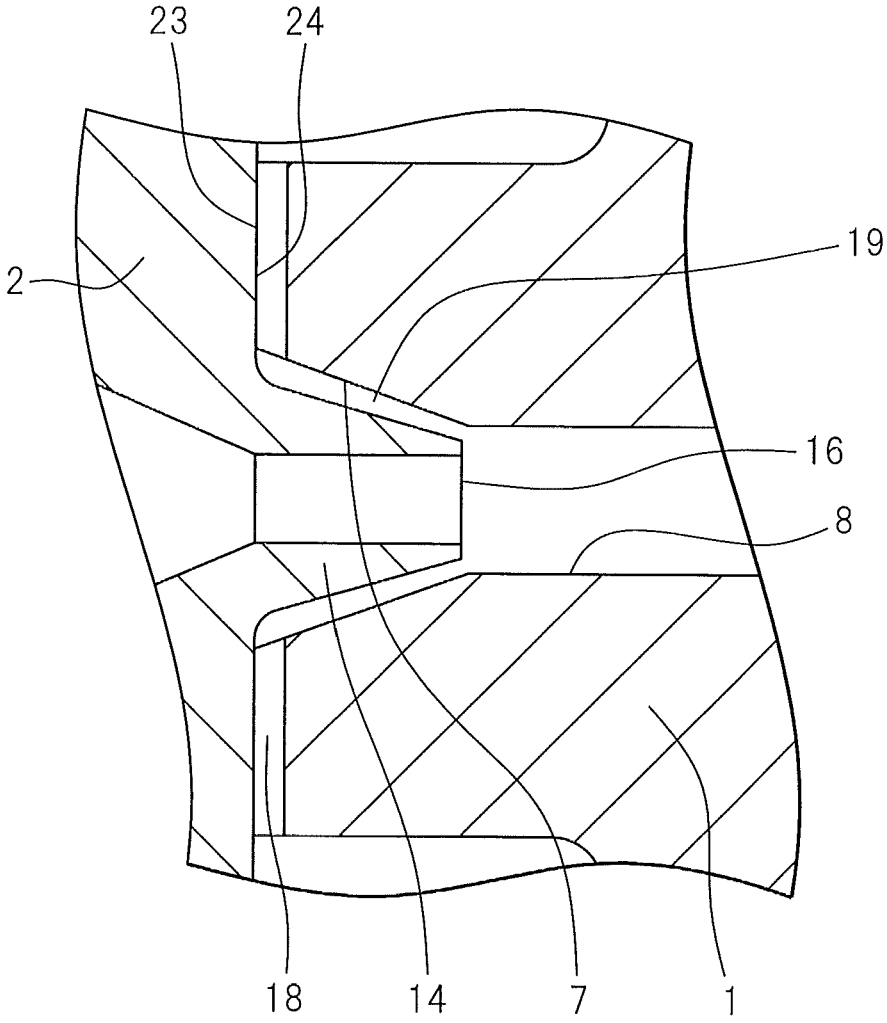
FIG. 2 is an enlarged view of a major portion of FIG. 1.

An in-line-type fluid mixer according to a first embodiment of the invention will be described below with reference to FIGS. 1 to 6. FIG. 1 is a lengthwise sectional view showing the constitution of the in-line-type fluid mixer according to the first embodiment of the invention, and FIG. 2 is an enlarged view of a major portion of FIG. 1. The fluid mixer includes a main body 1 having a substantially cylindrical outer shape, and a nozzle member 2 having a substantially cylindrical outer shape and being fitted to the main body 1.

The main body 1 is provided, in its one end surface, with a receiving portion 6 into which the nozzle member 2 is fitted and is provided, in its other end surface, with an outlet port 22 that forms an outlet channel 5. The receiving portion 6 has an internally threaded portion 11 formed in the inner circumferential surface thereof at the side of the port. The receiving portion 6 has an circular ring groove portion 10 formed on the bottom surface 23 thereof, and the outer circumferential surface of the circular ring groove portion 10 is positioned substantially on line extending from the internally threaded portion 11. The main body 1 includes, in the inside thereof, a contracting portion 7 formed at the center of the bottom surface of the receiving portion 6 and decreasing in diameter into a circular truncated cone shape toward the outlet port 22, a throat portion (narrower portion) 8 continuously provided to the contracting portion 7 and forming a cylindrical surface, and a flaring portion 9 continuously provided to the throat portion 8 and increasing in diameter into a circular truncated cone shape toward the outlet port 22, all of which are concentric with the central axis (a central axis of a cylinder) of the main body 1. By the contracting portion 7, the throat portion 8 and the flaring portion 9, the outlet channel 5 is defined for producing a Venturi effect from the contracting portion 7 to the outlet port 22. A channel is formed by a cylindrical surface from the end of the flaring portion 9 to the outlet port 22.

Figure 3:
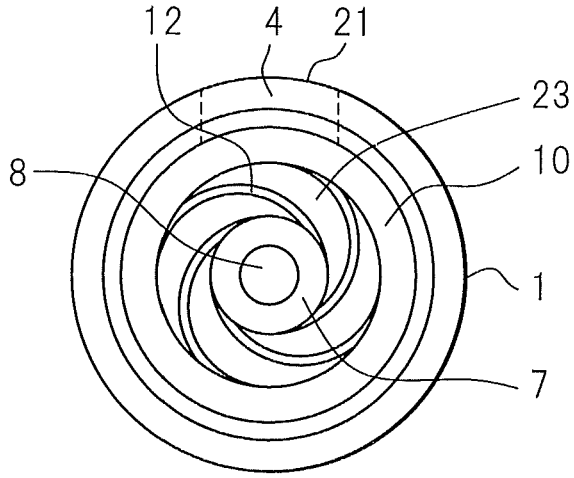
FIG. 3 is a front view showing groove portions formed in a main body of the in-line-type fluid mixer of FIG. 1.

FIG. 3 is a front view (a sectional view taken along line III-III in FIG. 1) of the bottom surface 23 of the receiving portion 6 of the main body 1. As shown in FIG. 3, a second inlet port 21 is formed in the outer circumferential surface of the main body 1 at a predetermined position in the circumferential direction (at the top in FIG. 3), and is communicated with the circular ring groove portion 10. On the bottom surface 23 of the receiving portion 6, there are a plurality of radially curved groove portions 12 from the circular ring groove portion 10 to the peripheral edge of the contracting portion 7 at an equal interval in the circumferential direction.

As shown in FIG. 1, the nozzle member 2 has a cylindrical portion 13 provided with an externally threaded portion 15 on the outer circumferential surface thereof, and a protruding portion 14 formed on one end surface of the cylindrical portion 13 and protruding so as to be circular truncated cone shaped and concentric with the cylindrical portion 13. A first inlet port 20 is formed in the other end surface of the cylindrical portion 13, and a discharge port 16 is formed in the end surface of the protruding portion 14. Inside the nozzle member 2, there is a tapered portion 17 having a circular truncated cone shape that decreases in diameter from the midway of the channel toward the discharge port 16 and is concentric with the central axis of the nozzle member 2, and there is a first inlet channel 3 extending from the first inlet port 20 to the discharge port 16, so as to become narrower at the outlet side. A channel is formed by the cylindrical surface from the first inlet port 20 to one end of the tapered portion 17 and from the other end of the tapered portion 17 to the discharge port 16.

The externally threaded portion 15 of the nozzle member 2 is screwed into the internally threaded portion 11 of the receiving portion 6 of the main body 1 in a sealing manner until the end surface 24 of the cylindrical portion 13 comes in contact with the bottom surface 23 of the receiving portion 6 of the main body 1 and, thus, the nozzle member 2 is fitted into the receiving portion 6 of the main body 1. In this state, the protruding portion (convex portion) 14 is accommodated in the contracting portion (concave portion) 7 of the main body 1, and a communication channel 18 is formed by the groove portions 12 formed on the bottom surface 23 of the receiving portion 6 of the main body 1 and by the end surface 24 of the nozzle member 2 at the side of the protruding portion 14. Further, a clearance is maintained between the inner circumferential surface (tapered surface) of the contracting portion 7 of the main body 1 and the outer circumferential surface (tapered surface) of the protruding portion 14 of the nozzle member 2, and an annular channel 19 is formed by the clearance so as to extend along these tapered surfaces.

Thus, there is a second inlet channel 4 that is communicated with the throat portion 8 of the main body 1 from the second inlet port 21 through the circular ring groove portion 10, the communication channel 18 and the annular channel 19, and becomes narrower at the outlet side. The bottom surface 23 of the receiving portion 6 of the main body 1 may not be in contact with the end surface 24 of the nozzle member 2 at the side of the protruding portion 14, thereby forming a suitable clearance between them. When the clearance is maintained, the communication channel 18 is defined by the clearance and by the groove portions 12 to communicate the circular ring groove portion 10 and the annular channel 19 with each other.

Figure 4:
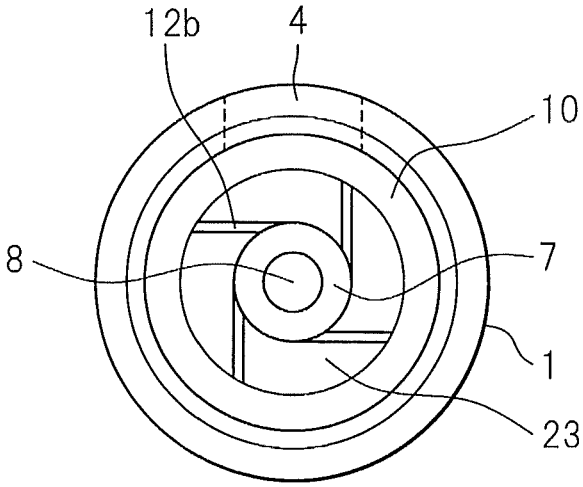
FIG. 4 is a front view showing another variation of the groove portions formed in the main body of the in-line-type fluid mixer of FIG. 1.

The shape of the groove portions 12 is not limited to the one shown in FIG. 3. As shown in FIG. 4, for instance, a plurality of groove portions 12*b* may be linearly formed so as to deviate relative to the central axis of the first inlet channel 3 in the nozzle member 2. Namely, the groove portions 12*b* may be formed along a straight line extending outward in the radial direction without intersecting the central axis of the channel in the nozzle member 2. Therefore, the shape of the groove portion 12 is not limited to any particular shape, provided that it is in communication tangentially in relation to the circumference of the circumferential edge of the contracting portion 7 so as to generate a whirling stream. The sectional shape and the number of the groove portion 12 is not limited to any particular sectional shape or any particular number of the groove portions 12, either.

The material of the main body 1 and the nozzle member 2 is not limited to any particular material, provided that the material does not erode under influence of the fluids that are used. Any material such as polyvinyl chloride, polypropylene, and polyethylene may be used. If corrosive fluids are used, it is preferable to use a fluorine-containing resin such as polytetrafluoroethylene, polyvinylidene fluoride, and tetrafluoroethylene/perfluoroalkylvinyl ether copolymer resin. The fluorine-containing resin is preferable, since it can be used with corrosive fluids and, in addition, there is no risk of the piping member eroding in the case where corrosive gases flow therethrough. The material constituting the main body 1 or the nozzle member 2 may be transparent or semitransparent. This is preferable since the state of the fluids being mixed together can be visually observed. Depending upon a substance flowing to the fluid mixer, the materials of each part may be a metal such as iron, copper, copper alloy, brass, aluminum, stainless steel or titanium, or alloys thereof. In particular, if the fluid is a food product, it is preferable to use stainless steel which is sanitary and has a long life. The main body and the nozzle can be assembled together by any method that maintains sealing of the inner fluids, such as screwing, welding, melt-adhesion, adhesion, anchoring by pin or fitting. Pipes (not shown) are connected to the first inlet port 20, the second inlet port 21 and the outlet port 22, respectively, in order to introduce and discharge the fluids. However, the connecting manner is not limited to any particular manner.

An operation of the first embodiment of the invention will be described below. In the in-line-type fluid mixer according to the first embodiment of the invention, there are options either to suck a secondary fluid from the second inlet port 21 by the negative pressure, which is generated, as a primary fluid is introduced from the first inlet port 20 or to suck the secondary fluid from the first inlet port 20 by the negative pressure, which is generated in the narrowing channel, as the primary fluid is introduced from the second inlet port 21.

First, the option to introduce the primary fluid from the second inlet port 21, which results in more effective mixing of the two fluids together, will be described below.

In FIG. 1, the primary fluid is introduced from the second inlet port 21 by a pressurized feeding part such as pump, and flows through the second inlet channel 4. Namely, the primary fluid flows into the throat portion 8 of the main body 1 from the circular ring groove portion 10 through the communication channel 18 and the annular channel 19. When the primary fluid flows from the circular ring groove portion 10 to the communication channel 18, the opening area of the channel contracts and, therefore, the circular ring groove portion 10 is temporarily filled with the primary fluid. Since the primary fluid in this state flows into the annular channel 19 through the communication channel 18, the primary fluid homogeneously flows into the throat portion 8 over the entire circumference of the channel. Since the communication channel 18 is designed such that the primary fluid flows in a radially curved manner in relation to the annular channel 19, the primary fluid introduced to the circular ring groove portion 10 whirls in the annular channel 19 and homogeneously flows into the throat portion 8 over the entire circumference of the annular channel 19. The primary fluid flows into the throat portion 8, and flows through the outlet channel 5 in a whirling stream. Namely, the primary fluid flows to the outlet port 22 through the flaring portion 9, while the whirling stream flows along the inner circumferential surface of the flaring portion 9. As a result, the radius of revolution of the whirling stream gradually increases.

The primary fluid flowing from the second inlet port 21 into the throat portion 8 through the annular channel 19 further flows through the contracting portion 7 which is the narrowing channel, the throat portion 8 and the flaring portion 9 successively, and, as a result, a negative pressure is generated in the throat portion 8 due to the Venturi effect. As the negative pressure is generated in the throat portion 8, the secondary fluid is sucked into the throat portion 8 via the first inlet port 20 and the first inlet channel 3 of the nozzle member 2 and the discharge port 16 at a tip of the protruding portion 14, and joins the primary fluid at the throat portion 8. The primary fluid in a whirling stream flows into the throat portion 8 through the annular channel 19 over the entire circumference thereof without deviation. Due to a stirring effect of the primary fluid in a whirling stream, the primary fluid and the secondary fluid are mixed together evenly and homogeneously.

As the velocity of flow of the mixed fluid increases, cavitation occurs when the fluid flows from the throat portion 8 to the flaring portion 9. In this embodiment, however, the primary fluid flowing from the annular channel 19 into the throat portion 8 flows in a whirling stream along the inner circumferential surface of the flaring portion 9. Therefore, air bubbles produced due to the cavitation are gathered near the axis of the pipe channel. Accordingly, the pipe walls are prevented from being damaged by the cavitation. In addition, due to the cavitation, the primary fluid and the secondary fluid are further stirred and mixed together even more evenly and homogeneously.

In general, a static pressure of a fluid decreases with an increase in the velocity of flow of the fluid flowing in a piping. However, in the case of the fluids flowing through the pipe, there is an additional flow of a whirling stream. Therefore, an absolute velocity of the flow increases more than that of an ordinary axial flow, even when the flow rate remains unchanged, and the static pressure decreases more. Therefore, in the case where the secondary fluid introduced via the first inlet channel 3 is sucked by generating a negative pressure in the narrowing channel by the primary fluid flowing into the throat portion 8 from the annular channel 19 as in this embodiment, the more secondary fluid can be sucked from the first inlet channel 3 by the greater negative pressure resulting from the whirling stream. This increases a capacity of sucking the secondary fluid and widens an adjustable range of the mixing ratio between the primary fluid and the secondary fluid. With the whirling stream generated as described above, the in-line-type fluid mixer capable of adjusting the mixing ratio within a wider range can be provided.

Test results of flow rate-measuring will be described in the case where the primary fluid in a whirling stream flows in from the annular channel 19 (Example 1) and in the case where the primary fluid in a non-whirling stream flows in (Comparative Example 1). The throat portion 8 of the in-line-type fluid mixer used in the flow rate-measuring tests has an inner diameter of 6 mm, and the discharge port 16 of the nozzle member 2 has an inner diameter of 3 mm. The primary fluid (water) was introduced by a pump into the second inlet port 21 of the apparatus used for the tests, and the secondary fluid (water) was introduced into the first inlet port 20 without using a pressurized feeding part. Flow rates were measured by means of flow meters installed near the ports 20 and 21.

Example 1

In Example 1, an apparatus was configured such that the groove portions 12 of the main body 1 were formed in a radially curved manner as shown in FIG. 3, so as to generate a whirling stream. By using this apparatus, the flow rate of the primary fluid (water) introduced into the second inlet channel 4 and the flow rate of the secondary fluid (water) sucked from the first inlet channel 3 were measured, respectively, when the flow rate of the primary fluid flowing through the apparatus varies.

Comparative Example 1

Figure 5:
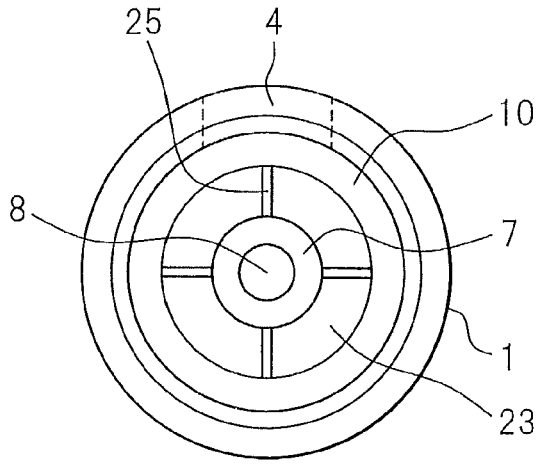
FIG. 5 is a front view showing groove portions formed in a main body of an in-line-type fluid mixer for comparative testing.

In Comparative Example 1, the apparatus is configured such that the groove portions 25 of the main body 1 were radially formed from the central axis as shown in FIG. 5, so as not to generate a whirling stream. By using this apparatus, the flow rate of the primary fluid (water) introduced into the second inlet channel 4 and the flow rate of the secondary fluid (water) sucked from the first inlet channel 3 were measured, respectively, when the flow rate of the primary fluid flowing through the apparatus varies.

Figure 6:
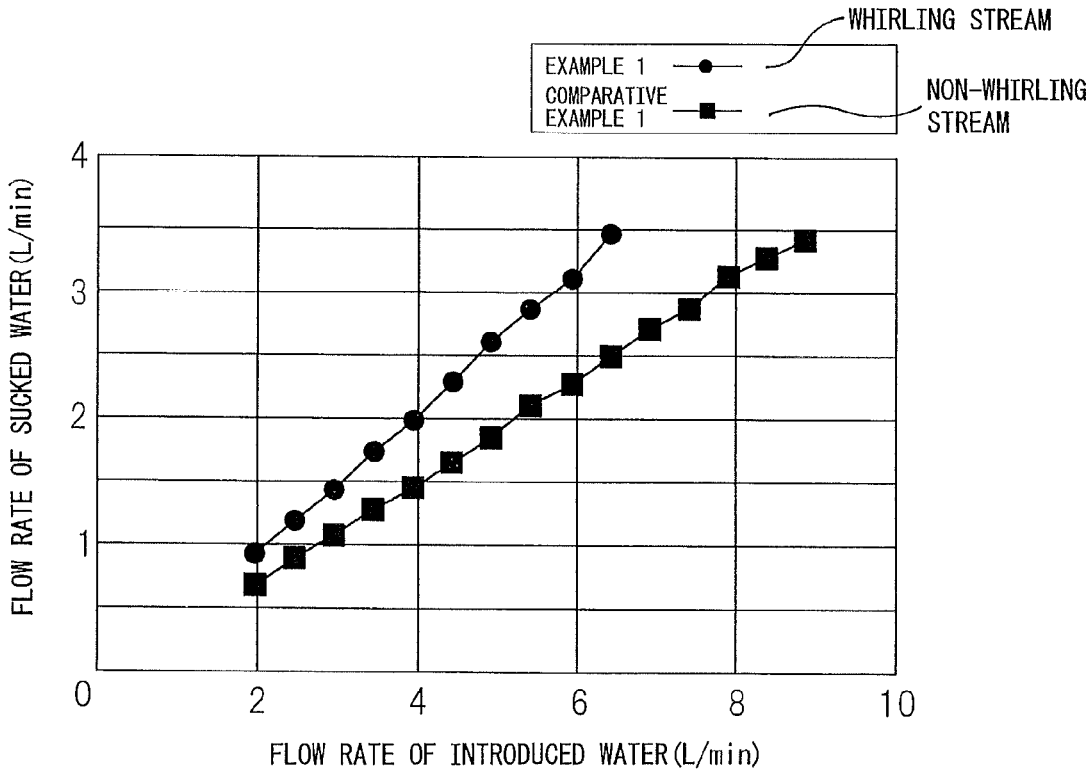
FIG. 6 is a graph showing a performance of the in-line-type fluid mixer of the first embodiment of the invention.

FIG. 6 is a performance diagram showing the test results of the Example 1 and the Comparative Example 1. In the diagram, the horizontal axis represents the flow rate of the primary fluid (water) introduced into the second inlet port 21 and the vertical axis represents the flow rate of the secondary fluid (water) sucked from the first inlet port 20. It can be seen from FIG. 6 that even with the same flow rates, more secondary fluid was sucked in when the whirling stream was generated (Example 1) than when the whirling stream was not generated (Comparative Example).

Next, the case where the primary fluid is introduced from the first inlet port 20 will be described.

The primary fluid introduced by the pressurized feeding part such as a pump from the first inlet port 20 flows through the first inlet channel 3. Namely, the primary fluid flows into the throat portion 8 from the discharge port 16 via the tapered portion 17. The channel becomes narrower at the tapered portion 17, and thus, the velocity of flow of the primary fluid increases. The primary fluid flowing at an increased velocity flows from the discharge port 16 into the throat portion 8, producing a negative pressure in the throat portion 8. Due to the negative pressure generated in the throat portion 8, the secondary fluid is sucked from the second inlet port 21 through the annular channel 19. The sucked secondary fluid flows in a whirling stream, as it passes through the radially curved communication channel 18, and flows into the throat portion 8. The effect of mixing the primary fluid and the secondary fluid together is the same as in the case of the primary fluid introduced from the second inlet port 21, and thus, will not be described.

According to the in-line-type fluid mixer of the embodiment described above, the secondary fluid can be sucked in due to the negative pressure generated in the throat portion 8 either in the case where the primary fluid is introduced from the first inlet port 20 or in the case where the primary fluid is introduced from the second inlet port 21. Therefore, there is no need to provide a pressurized feeding part such as a pump at the side of the channel through which the secondary fluid flows, and the number of parts can be reduced. In addition, the stirring effect can be achieved by generating the whirling stream, and more secondary fluid can be sucked in.

In the above embodiment, the primary fluid is introduced either from the first inlet port 20 or the second inlet port 21, generating a negative pressure in the channel so as to suck the secondary fluid from either of the other inlet channel. However, it may also be possible to introduce the secondary fluid into the in-line-type fluid mixer with the aid of a pressurized feeding part such as a pump. In this case, a favorable effect of mixing the fluids can be achieved, even when the discharge pressure of the pressurized feeding part is low. Also in this case, the stirring effect by the whirling stream and the effect of preventing the inner walls of pipes from being damaged due to the cavitation can be achieved.

In the above embodiment, the protruding portion 14 of the nozzle member 2 has a circular truncated cone shape, but may also have a cylindrical shape. It is preferable that the protruding portion 14 has a length which is substantially equal to or slightly shorter than the length of the contracting portion 7 in the axial direction. It is preferable that the discharge port 16 of the nozzle member 2 has an inner diameter smaller than the inner diameter of the throat portion 8 of the main body 1 and that a ratio $\alpha$ of the inner diameter of the discharge port 16 in relation to the inner diameter of the throat portion 8 is within a range of 0.5 to 0.9, for example. That is, in order to enhance the mixing of fluids at the throat portion 8 by decreasing the inner diameter of the discharge port 16 so to be smaller than the inner diameter of the throat portion 8, it is preferable that the fluid flows from the discharge port 16 into the throat portion 8 at an increased velocity and that the ratio $\alpha$ is 0.9 or smaller. In addition, in order to maintain the flow rate of the fluid flowing through the discharge port 16, it is preferable that $\alpha$ is 0.5 or greater. On the other hand, it is preferable that the outer diameter on the circumferential edge of the end surface of the protruding portion 14 at the side of the outlet port 22 is slightly smaller than the inner diameter of the throat portion 8, and that the ratio $\beta$ of the outer diameter in relation to the inner diameter of the throat portion 8 is within a range of 0.7 to 0.95. Thus, in order to facilitate the whirling stream flowing from the annular channel 19 into the throat portion 8 along the inner circumferential surface of the throat portion 8 by decreasing the outer diameter of the circumferential edge portion so as to be smaller than the inner diameter of the throat portion 8, it is preferable that $\beta$ is 0.7 or greater. Further, in order to form the annular channel 19 by maintaining a clearance relative to the inner circumferential surface of the contracting portion 7, it is preferable that $\beta$ is 0.95 or smaller.

Different types of the fluids to be mixed together by the in-line-type fluid mixer may be different fluids of different phases such as gas and liquid, etc., fluids having different temperature, different concentration or different viscosity, or different fluids of different substances. For instance, the invention may be even applied to a case where the one of the fluids is liquid and the other is gas, and the gas is mixed into and dissolved in the liquid. In this case, if the fluid is introduced from one channel into the fluid mixer under a condition where the cavitation occurs, the gas dissolved in the liquid turns into bubbles due to the cavitation phenomenon and is deaerated from the liquid, allowing other gas (e.g., ozone gas) introduced from the other channel to be effectively dissolved in the liquid.

Second Embodiment

Figure 7:
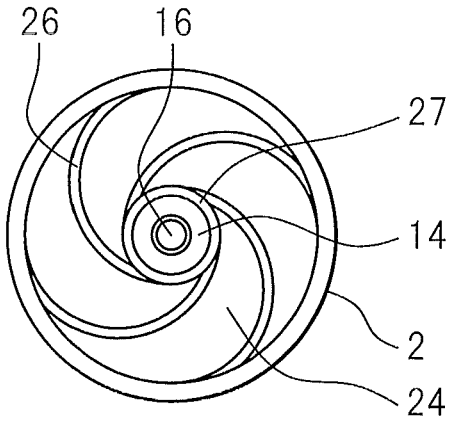
FIG. 7 is a front view showing the groove portions formed in a nozzle of an in-line-type fluid mixer according to a second embodiment of the invention.

A second embodiment of the invention will be described with reference to FIGS. 7 and 8. The second embodiment is different from the first embodiment in regard to the configuration of the communication channel 18. Specifically, in the first embodiment, the communication channel 18 is formed by the groove portions 12 on the bottom surface 23 of the receiving portion 6 of the main body 1. In the second embodiment, on the other hand, groove portions are formed on the end surface 24 of the nozzle member 2 at the side of the protruding portion 14. FIG. 7 is a view showing the configuration of a major portion of the in-line-type fluid mixer according to the second embodiment, and is a front view of the nozzle member 2 taken from the side of the outlet port 22 in FIG. 1. The same elements as those in FIGS. 1 and 2 are denoted by the same reference numerals, and the following description will be mainly directed to differences from the first embodiment.

Referring to FIG. 7, a plurality of groove portions 26 are provided on the end surface 24 of the nozzle member 2 uniformly in the circumferential direction, so as to form the communication channel 18. Although not shown, no groove portion is formed on the bottom surface 23 of the receiving portion 6 of the main body 1. The groove portions 26 are formed in a radially curved manner from the outer circumferential edge on the end surface of the nozzle member 2 so as to be communicated with the circumference of the outer circumferential groove portion 27 formed at the circumferential edge of the root of the protruding portion 14 in a tangential manner. When the nozzle member 2 is screwed into the main body 1, the communication channel 18 is formed by the groove portions 26 of the nozzle member 2 and the bottom surface 23 of the receiving portion 6 of the main body 1. In this manner, the second inlet channel 4 is formed so as to be communicated with the throat portion 8 of the main body 1 from the second inlet port 21 through the circular ring groove portion 10, the communication channel 18 and the annular channel 19. In this case, the fluid that has flown through the communication channel 18 turns into a whirling stream flowing along the outer circumferential surface of the protruding portion 14. The other configurations and operations of this embodiment are the same as those of the first embodiment and thus, the description thereon is omitted.

Figure 8:
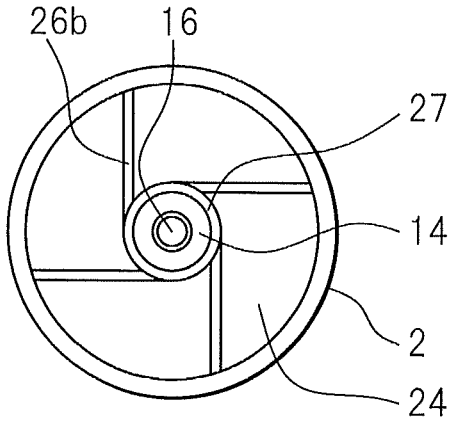
FIG. 8 is a front view showing another variation of the groove portions formed in the nozzle of FIG. 7.

The groove portions 26 are not limited to the radially curved ones as shown in FIG. 7, but may be the groove portions 26*b* linearly formed so as to deviate relative to the central axis of the channel as shown in FIG. 8. The shape of the groove portions is not limited to any particular shape, provided that they are communicated with the circumference of the outer circumferential groove portion 27 in a tangential manner. In addition, the sectional shape of the grooves or the number of the grooves is not limited to any particular type.

By providing the nozzle member 2 with the groove portions 26 according to this embodiment, the groove portions 26 can be easily cleaned when disassembled. Further, the nozzle member 2 can be replaced with other nozzle member 2 having groove portions 26 of a different configuration, facilitating modification of the conditions for introducing the primary fluid or for sucking the secondary fluid.

Third Embodiment

Figure 9A:
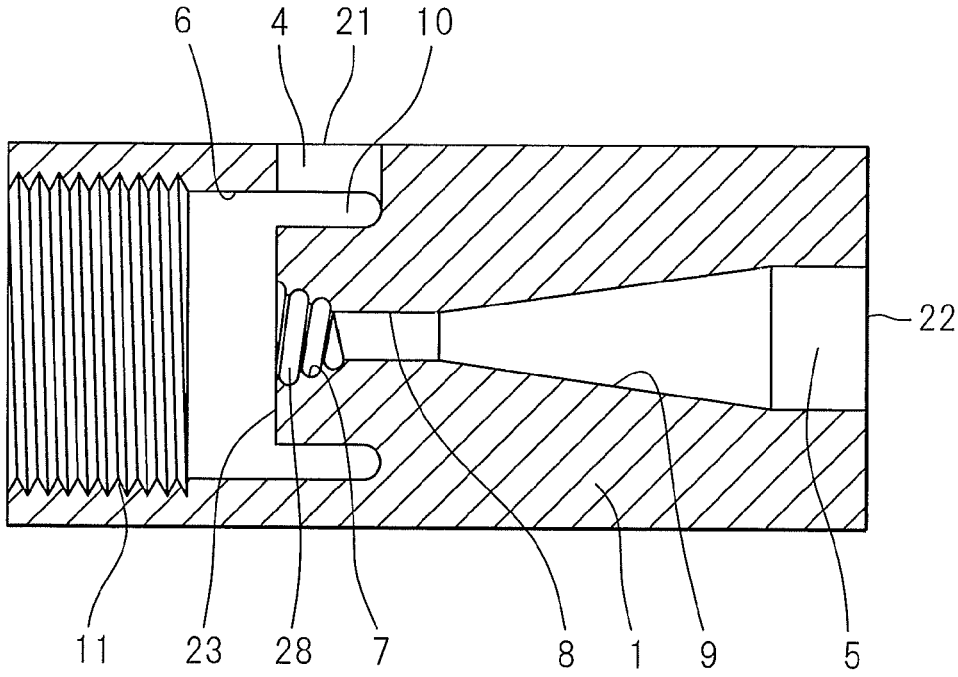
FIG. 9*a* is a lengthwise sectional view showing a main body of an in-line-type fluid mixer according to a third embodiment of the invention.

A third embodiment of the invention will be described with reference to FIGS. 9*a* and 9*b*. The third embodiment is different from the first embodiment in regard to the configuration of the communication channel 18. Specifically, in the first embodiment, the communication channel 18 is formed by the groove portions 12 on the bottom surface 23 of the receiving portion at the outer side in the radial direction of the tapered surface where the main body 1 and the nozzle member 2 are fitted with each other. In the third embodiment, however, the groove portions are formed in the tapered surface. FIG. 9*a* is a lengthwise sectional view showing the configuration of the main body 1 of the in-line-type fluid mixer according to the third embodiment. The same elements as those in FIGS. 1 and 2 are denoted by the same reference numerals, and the following description will be mainly directed to differences from the first embodiment.

Referring to FIG. 9*a*, a spiral groove portion 28 having a spiral shape is formed in the inner circumferential surface of the contracting portion 7 of the main body 1. The nozzle member 2 is screwed into the main body 1 so as to maintain a suitable clearance between the bottom surface 23 of the receiving portion 6 of the main body 1 and the end surface 24 of the nozzle member 2 at the side of the protruding portion 14. The communication channel 18 is formed by the clearance. The annular channel 19 is formed by the outer circumferential surface of the protruding portion 14 of the nozzle member 2 and by the spiral groove portion 28 in the contracting portion 7 of the main body 1. In this way, the second inlet channel 4 is formed to be communicated with the throat portion 8 of the main body 1 from the second inlet port 21 through the circular ring groove portion 10, the communication channel 18 and the annular channel 19. In this case, the fluid flowing through the annular channel 19 turns into a whirling stream flowing along the outer circumferential surface of the protruding portion 14. The other configurations of this embodiment are the same as those of the first embodiment and thus, the description thereon is omitted.

An operation of the third embodiment will be described next. The primary fluid that has flown from the second inlet port 21 into the annular channel 19 through the communication channel 18 flows through the annular channel having a spiral shape formed by the spiral groove portion 28 into the throat portion 8 while whirling in the annular channel 19. The primary fluid that has flown into the throat portion 8 passes through the flaring portion 9 in the outlet channel 5 in a whirling manner, and flows toward the outlet port 22. The other operations of this embodiment are the same as those of the first embodiment and thus, the description thereon is omitted.

The number and the sectional shape of the spiral groove portions 28 are not limited to any particular type. The inner circumferential surface of the contracting portion 7 and the outer circumferential surface of the protruding portion 14 of the nozzle member 2 may be in contact with each other, or a suitable clearance may be maintained between them. By bringing the inner circumferential surface of the contracting portion 7 and the outer circumferential surface of the protruding portion 14 into contact with each other, the channel axis of the contracting portion 7 and that of the protruding portion 14 can be brought into alignment. The alignment between the channel axis of the contracting portion 7 and that of the protruding portion 14 is important particularly in the case where the channels have small diameters. By adjusting the clearance between the inner circumferential surface of the contracting portion 7 and the outer circumferential surface of the protruding portion 14, the conditions for introducing the primary fluid or for sucking the secondary fluid can be modified.

Figure 9B:
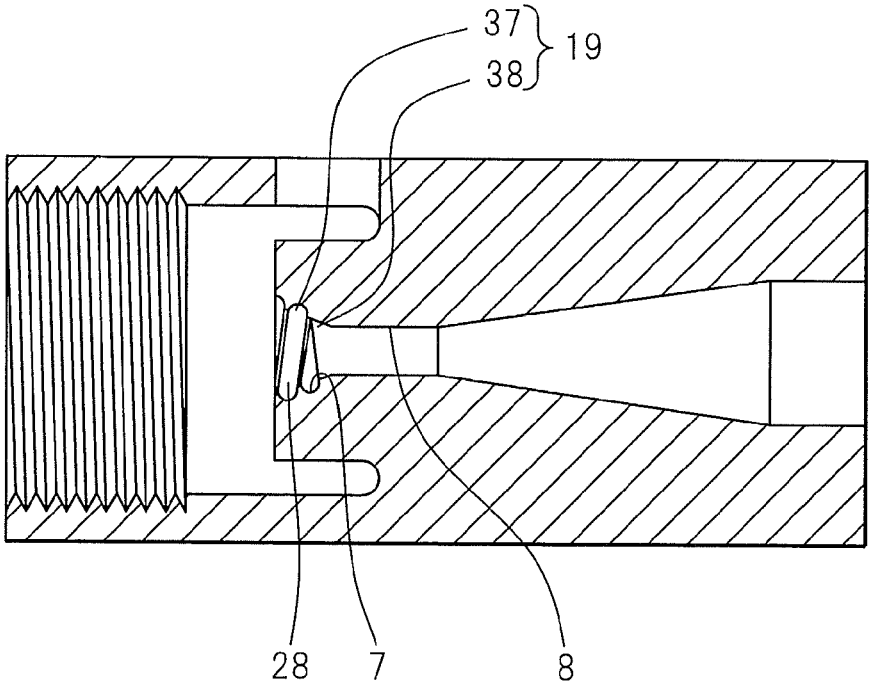
FIG. 9*b* is a view showing a modified example of FIG. 9*a;*

As shown in FIG. 9*b*, the spiral groove portion 28 may be only formed from the upstream end of the contracting portion 7 to the intermediate portion thereof, and the contracting portion 7 in the downstream of the intermediate portion may be formed to have a flat shape, instead of the spiral groove portion 28 formed to extend over the entire inner circumferential surface of the contracting portion 7. According to this configuration, the annular channel 19 between the contracting portion 7 and the protruding portion 14 has a whirling portion 37 including the spiral groove portion 28 and a flat portion 38 simply formed as a clearance in the downstream of the spiral groove portions 28. The length of the whirling portion 37 is not limited to any particular length, provided that it is capable of producing a whirling stream. The length of the flat portion 38 is not limited to any particular length, provided that it allows the whirling stream generated in the whirling portion 37 to uniformly flow into the throat portion 8 from the entire circumference of the annular channel 19.

Fourth Embodiment

Figure 10:
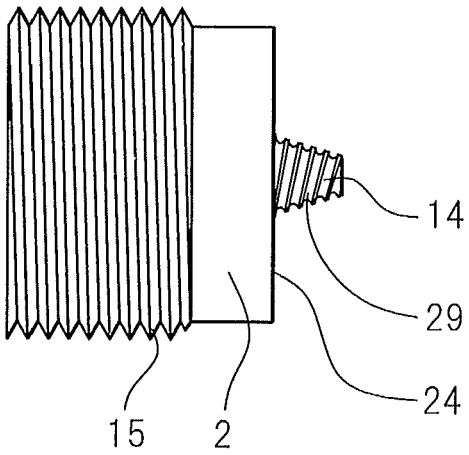
FIG. 10 is a side view showing a nozzle of an in-line-type fluid mixer according to a fourth embodiment of the invention.

A fourth embodiment of the invention will be described with reference to FIG. 10. In the third embodiment, the spiral groove portion 28 is formed in the inner circumferential surface of the contracting portion 7 of the main body 1. In the fourth embodiment, however, spiral groove portions are formed in the outer circumferential surface of the protruding portion 14 of the nozzle member 2. FIG. 10 is a side view showing the configuration of the nozzle member 2 of the in-line-type fluid mixer according to the fourth embodiment. The same elements as those in FIGS. 1 and 2 are denoted by the same reference numerals, and the following description will be mainly directed to differences from the first embodiment.

As shown in FIG. 10, spiral groove portions 29 are formed in the outer circumferential surface of the protruding portion 14 of the nozzle member 2. The nozzle member 2 is screwed into the main body 1 so as to maintain a suitable clearance between the bottom surface 23 of the receiving portion 6 of the main body 1 and the end surface 24 of the nozzle member 2 at the side of the protruding portion 14. The communication channel 18 is formed by the clearance. The annular channel 19 is formed by the spiral groove portion 29 of the protruding portion 14 of the nozzle member 2 and by the inner circumferential surface of the contracting portion 7 of the main body 1. In this way, the second inlet channel 4 is formed to be communicated with the throat portion 8 of the main body 1 from the second inlet port 21 through the circular ring groove portion 10, the communication channel 18 and the annular channel 19. In this case, the fluid flowing through the annular channel 19 turns into a whirling stream flowing along the outer circumferential surface of the protruding portion 14. The other configurations and operations of this embodiment are the same as those of the third embodiment, and thus, the description thereon is omitted.

Fifth Embodiment

Figure 11A:
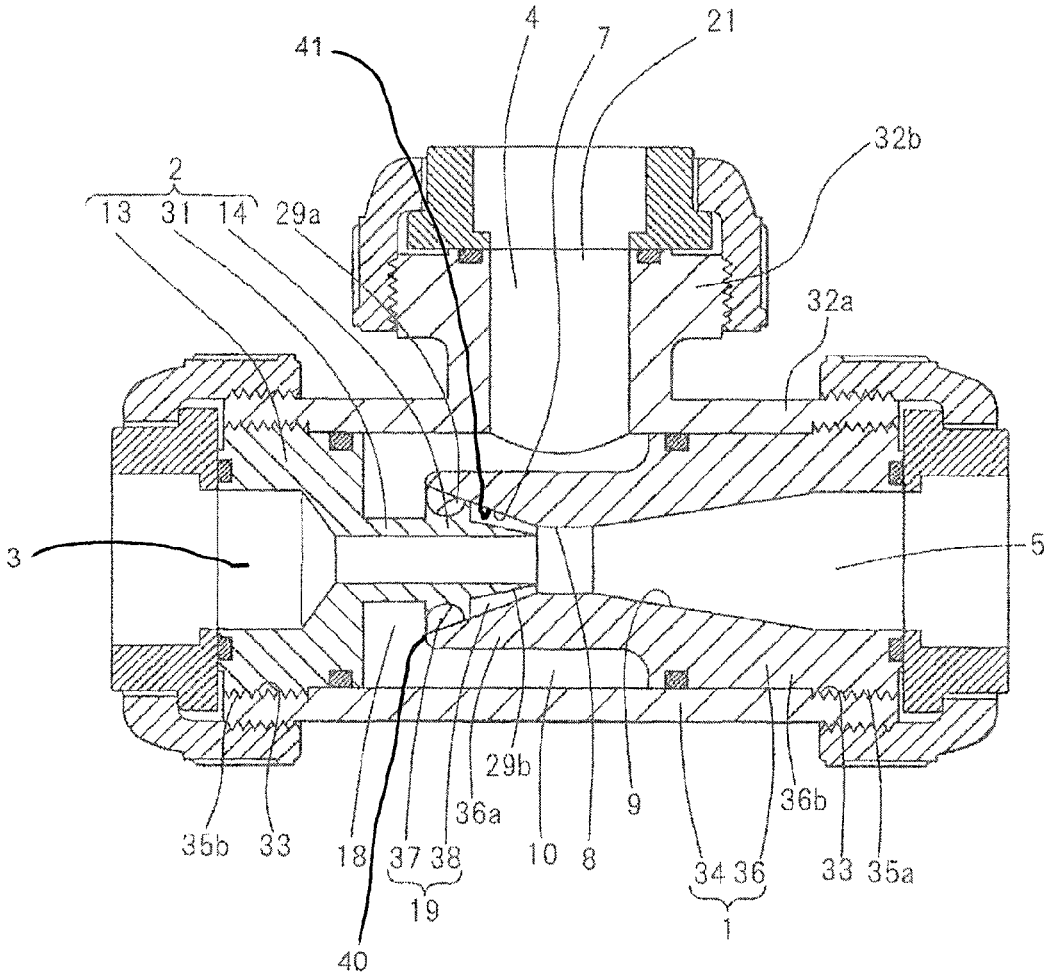
FIG. 11*a* is a sectional view showing an in-line-type fluid mixer according to a fifth embodiment of the invention.
Figure 11B:
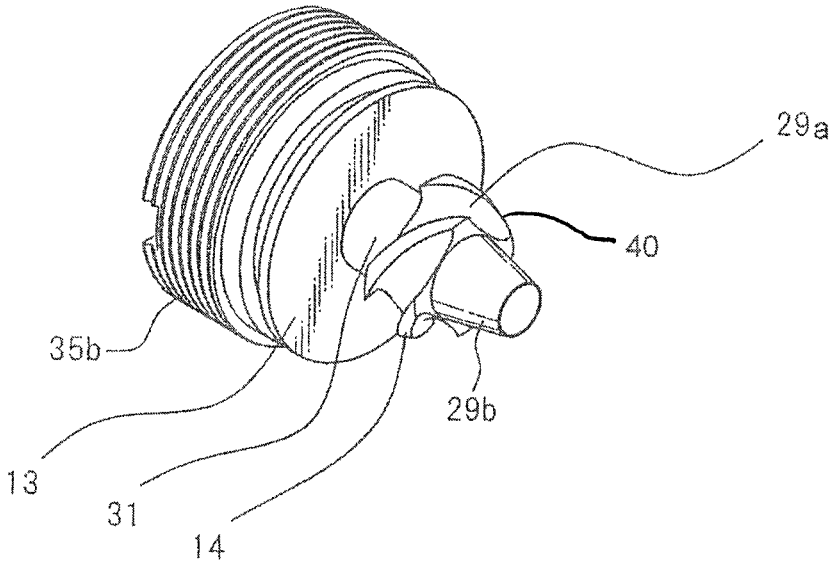
FIG. 11*b* is a perspective view showing the nozzle of FIG. 11*a;*

A fifth embodiment of the invention will be described with reference to FIGS. 11*a* and 11*b*. The fifth embodiment is different from the above-mentioned other embodiments mainly with regard to the shape of the nozzle member 2. Specifically, in the fifth embodiment, an intermediate portion 31 having a small outer diameter is provided between the cylindrical portion (first cylindrical portion) 13 and the protruding portion 14. FIG. 11*a* is a lengthwise sectional view showing the configuration of the in-line-type fluid mixer according to the fifth embodiment, and FIG. 11*b* is a perspective view showing the configuration of the nozzle member 2 of FIG. 11*a*. The same elements as those in FIGS. 1 and 2 are denoted by the same reference numerals, and the following description will be mainly directed to differences from the first embodiment.

Referring to FIG. 11*a*, the main body 1 is configured by a substantially T-shaped tubular casing portion 34 having a cylindrical portion (second cylindrical portion) 32*a* and a connecting portion 32*b* protruding from the side surface in the middle of the cylindrical portion 32*a*, and a channel portion 36 fitted into the casing portion 34. The second inlet port 21 is provided at the end of the connecting portion 32*b*. Internally threaded portions 33 are formed in the inner circumferential surfaces at both ends of the cylindrical portion 32*a*.

The channel portion 36 has a smaller-diameter portion 36*a* having a substantially cylindrical outer shape at one end side thereof, and a larger-diameter portion 36*b* having a substantially cylindrical outer shape at the other end side thereof and having a diameter larger than that of the smaller-diameter portion 36*a*. An externally threaded portion 35*a* is formed on the outer circumferential surface of the larger-diameter portion 36*b* at an end thereof. The externally threaded portion 35*a* is screwed into the internally threaded portion 33 of the casing portion 34, and the channel portion 36 is fitted to the casing portion 34. In the fitted state, the circular ring groove portion 10 is formed between the casing portion 34 and the smaller-diameter portion 36*a*. The circular ring groove portion 10 is communicated with the channel in the connecting portion 32*b*. In the interior of the channel portion 36, the contracting portion (concave portion) 7, the throat portion (narrower portion) 8 and the flaring portion 9 are provided in a continuing manner and the outlet channel 5 is also formed.

Between the cylindrical portion 13 and the protruding portion 14, the nozzle member 2 has the intermediate portion 31 having a substantially cylindrical outer shape concentric with the central axis of the nozzle member 2. The outer diameter of the intermediate portion 31 is smaller than the outer diameter of the cylindrical portion 13 and the outer diameter of the protruding portion 14, which are adjacent to the intermediate portion 31. A recess is formed by the intermediate portion 31 on the outer circumferential surface 40 of the nozzle member 2. As shown in FIG. 11*b*, spiral groove portions (groove portions) 29*a* are formed on the outer circumferential surface 40 of the protruding portion 14 at the larger diameter side thereof. A conical surface 29*b* is formed at the smaller diameter side thereof, so as to continue to the bottom surfaces of the spiral groove portions 29*a*. The angle of inclination (tapering angle) of the outer circumferential surfaces 40 of the spiral groove portion 29*a* is equal to the angle of inclination (tapering angle) of the inner circumferential surface 41 of the contracting portion 7. An externally threaded portion 35*b* is provided on the outer circumferential surface of the cylindrical portion 13 at an end thereof. As shown in FIG. 11*a*, the externally threaded portion 35*b* is screwed into the internally threaded portion 33 of the casing portion 34, so that the nozzle member 2 is fitted into the casing portion 34.

In the fitted state, the outer circumferential surface 40 of the spiral groove portions 29*a* of the protruding portion 14 come in contact with the inner circumferential surface 41 of the contracting portion 7 of the channel portion 36. The annular channel 19 consisting of the whirling portion 37 and the flat portion 38 is formed in the peripheries of the spiral groove portion 29*a* and the conical surface 29*b*, respectively. In the periphery of the intermediate portion 31, the communication channel 18 is formed by the upstream end surface of the channel portion 36, the downstream end surface of the cylindrical portion 13, the outer circumferential surface of the intermediate portion 31 and by the upstream end surface of the protruding portion 14. In this way, the second inlet channel 4 is formed so as to be communicated with the throat portion 8 from the second inlet port 21 through the circular ring groove portion 10, the communication channel 18 and the annular channel 19.

With such a configuration, the primary fluid that has been introduced via the second inlet port 21 flows through the communication channel 18, and flows into the whirling portion 37 from the upstream end surface of the protruding portion 14. The primary fluid that has flown into the whirling portion 37 turns into a whirling stream and, thereafter, flows through the flat portion 38 and uniformly flows into the throat portion 8 from the entire circumference of the annular channel 19.

In this embodiment, it is preferable that the flat portion 38 of the annular channel 19 has substantially the same sectional channel area both at the upstream side and the downstream side thereof. This allows a preferable flow to be maintained, since the flow of the primary fluid is prevented from changing in its velocity, flow rates, or whirling stream, as the primary fluid flows through the flat portion 38. Therefore, the secondary fluid can be stably and efficiently sucked into the throat portion 8 by the primary fluid flowing from the second inlet channel 4.

In this embodiment, it is preferable that the downstream end surface of the protruding portion 14 and the downstream edge portion of the contracting portion 8 (i.e., connecting portion between the contracting portion 7 and the throat portion 8) are positioned on the same plane perpendicular to the central axis of the nozzle member 2, or that the end surface of the protruding portion 14 is positioned slightly in the upstream of the edge portion of the contracting portion 7. Namely, it is desired that the downstream edge portion of the concave portion (i.e., the contracting portion 7) and the downstream end surface of the convex portion (i.e., the protruding portion 14) are provided substantially on the same plane. In this case, it is conceivable that cavitation occurs in the vicinity of the outlet of the annular channel 19 due to the increasing sectional area of the channel, when the primary fluid flows through the annular channel 19. With the primary fluid and the secondary fluid being mixed at points where the cavitation tends to occur, the primary fluid and the secondary fluid can be mixed together more homogeneously.

Concerning the relationship between the position of the downstream edge portion of the contracting portion 7 and the position of the downstream end surface of the protruding portion 14, even in the case where it is intended to position them on the same plane, the position of the end surface of the protruding portion 14 might deviate in the upstream or the downstream of the edge portion of the contracting portion 7 due to dimensional tolerance of the parts or due to errors in the assembling. Even in case where the end surface of the protruding portion 14 and the edge portion of the contracting portion 7 are not exactly on the same plane, but either one deviates in the upstream or downstream of the other, it should be understood that they are substantially on the same plane, and thus, such a case is also referred to as being on the same plane in this specification. Namely, the same plane is not limited to exactly the same plane, but also includes substantially the same plane.

In this embodiment, the main body 1 is configured by the casing portion 34 and the channel portion 36, and the channel portion 36 and the nozzle member 2 are screwed into the casing portion 34. Such a configuration facilitates an easy modification of the shapes of the communication channel 18 or the annular channel 19, and allows the flow of the primary fluid and the secondary fluid to be changed as necessary. The other configurations and operations of this embodiment are the same as those of the fourth embodiment, and thus, the description thereon is omitted. The whirling portion 37 and the flat portion 38 may be provided at the contracting portion 7 instead of the protruding portion 14.

Sixth Embodiment

Figure 12:
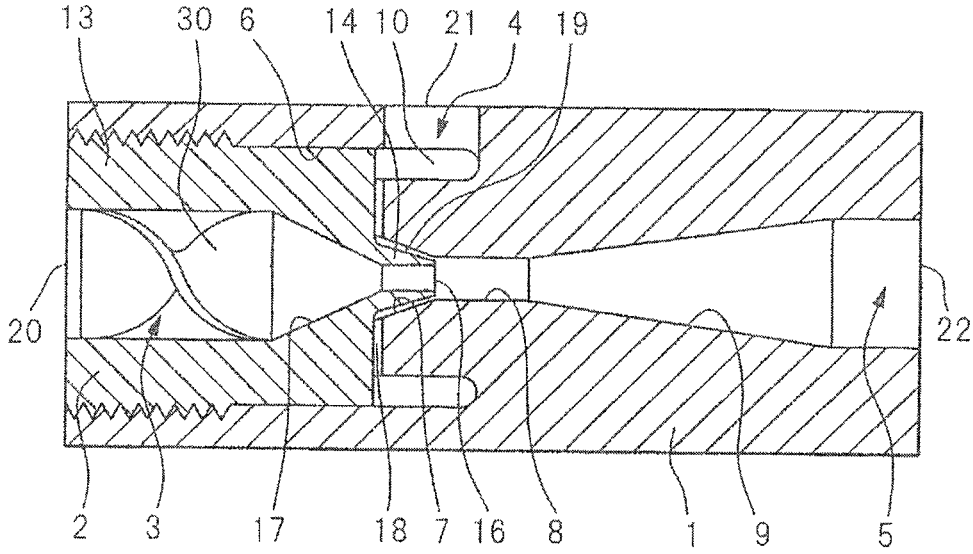
FIG. 12 is a lengthwise sectional view showing an in-line-type fluid mixer according to a sixth embodiment of the invention.
Figure 13:
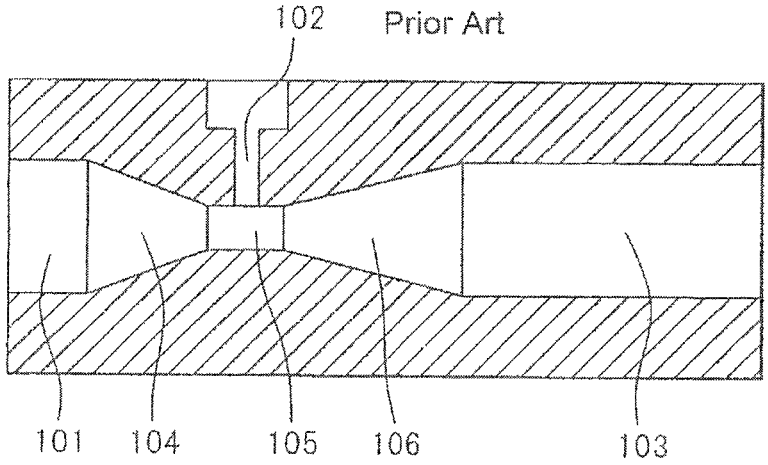
Fig.13 Prior Art
FIG. 13 is a lengthwise sectional view showing a conventional Venturi tube.
Figure 14:
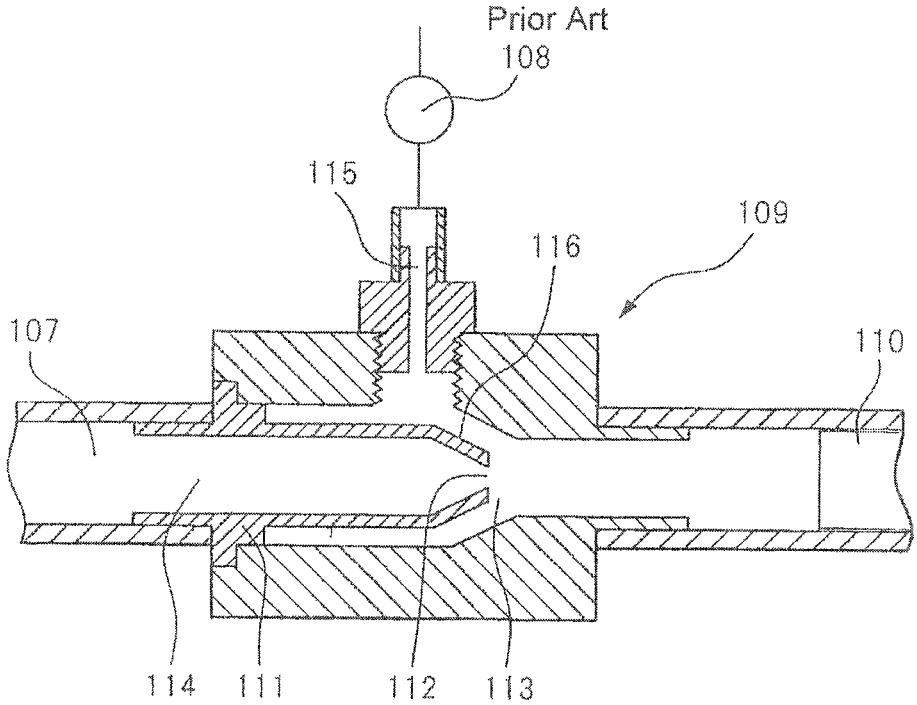
Fig.14 Prior Art
FIG. 14 is a lengthwise sectional view showing a conventional liquid mixer.

A sixth embodiment of the invention will be described with reference to FIG. 12. In the first embodiment, the whirling stream is generated in the second inlet channel 4 formed between the opposed surfaces of the main body 1 and the nozzle member 2. In the sixth embodiment, however, the whirling stream is generated in the first inlet channel 3 inside the nozzle member 2. FIG. 12 is a lengthwise sectional view showing the configuration of the in-line-type fluid mixer according to the sixth embodiment. The same elements as those in FIGS. 1 and 2 are denoted by the same reference numerals, and the following description will be mainly directed to differences from the first embodiment. As shown in FIG. 12, a whirler 30 is inserted in the first inlet channel 3 of the main body 1, and the whirler 30 has a twisted vanes shape having an outer diameter substantially equal to the inner diameter of the first inlet channel 3 in the upstream of the tapered portion 17. Although not shown, no groove (grooved portion 12 or the like in FIG. 3) is formed in the main body 1 or in the nozzle member 2. The nozzle member 2 is screwed into the main body 1 so as to maintain a suitable clearance between the bottom surface 23 of the receiving portion 6 of the main body 1 and the end surface 24 of the nozzle member 2 at the side of the protruding portion 14. The communication channel 18 is formed by the clearance. The annular channel 19 is formed by the outer circumferential surface of the protruding portion 14 of the nozzle member 2 and by the inner circumferential surface of the contracting portion 7 of the main body 1. In the first inlet channel 3, a whirling stream is generated due to the twist of the whirler 30, and flows from the discharge port 16 into the throat portion 8. The shape of the whirler 30 is not limited to the twisted vanes, provided that a whirling stream is generated. The other configurations of this embodiment are the same as those of the first embodiment, and the description thereon is omitted.

Next, an operation of the sixth embodiment will be described. In FIG. 12, the primary fluid that has been introduced from the first inlet port 20 into the first inlet channel 3 by means of a pressurized feeding part such as a pump turns into a whirling stream in the first inlet channel 3 by the action of the whirler 30, and flows into the throat portion 8 of the main body 1 via the discharge port 16 at the tip of the protruding portion 14 through the tapered portion 17. A negative pressure is generated in the throat portion 8 since the channel contracts in the tapered portion 17. Since the absolute velocity of flow of the whirling stream is greater at the outer circumferential side of the channel, the generated negative pressure is also greater in the outer circumferential portion. As a result, a greater negative pressure is generated in the vicinity of the port of the annular channel 19 continuously formed with the inner circumferential surface of the throat portion 8, and the secondary fluid is effectively sucked in from the second inlet port 21. The primary fluid and the secondary fluid are then mixed together in the throat portion 8. The primary fluid and the secondary fluid are evenly and homogeneously mixed together by the stirring action of the primary fluid that flows in from the entire circumference of the channel of the throat portion 8 in a whirling stream.

In contrast, in the case where the primary fluid is introduced from the second inlet port 21 by means of the pressurized feeding part such as a pump, the primary fluid that flows from the second inlet port 21 into the throat portion 8 through the annular channel 19 flows through the contracting portion 7 which is the contracting channel, the throat portion 8 and the flaring portion 9, so as to generate a negative pressure due to the Venturi effect. In this manner, the secondary fluid is sucked into the first inlet channel 3 from the first inlet port 20 through the discharge port 16 provided at the tip of the protruding portion of the nozzle member 2. The sucked secondary fluid turns into a whirling stream as it passes through the whirler 30, and flows into the throat portion 8. The action of mixing the primary fluid and the secondary fluid together is the same as in the case where the primary fluid is introduced from the first inlet port 20, and thus, the description thereon is omitted.

In the above first to fifth embodiments, the fluid flowing in from the second inlet port 21 turns into a whirling stream, and in the above sixth embodiment, the fluid flowing in from the first inlet port 20 turns into a whirling stream. However, both of the fluids flowing in from the first inlet port 20 and from the second inlet port 21 may turn into a whirling stream. Namely, an in-line-type fluid mixer may be configured by any combination of the first to sixth embodiments. In the case where the fluids flowing in from the first inlet port 20 and the second inlet port 21 both turn into a whirling stream, the whirling stream flowing into the throat portion 8 from the discharge port 16 and the whirling stream flowing into the throat portion 8 from the annular channel 19 interfere with each other so as to provide mixing by an increased stirring effect. In order to further increase the stirring effect, it is preferable that the respective whirling streams whirl in the directions opposite to each other.

In the above embodiments, the first inlet port 20 (first inlet portion) is formed in the nozzle body 2, and the tapered portion 17 and the discharge port 16 (first passage portion) are provided so as to extend in a lengthwise direction, so that the first inlet channel 3 extends from the first inlet port 20 to the discharge port 16. However, the configuration of the first channel-forming part is not limited to the above-mentioned one. The second inlet port 21 (second inlet portion) is formed in the main body 1, and the communication channel 18 and the annular channel 19 are formed on the opposed surfaces (second passage portion) of the main body 1 and the nozzle member 9, so that the second inlet channel 4 extend from the second inlet port 21 to the annular channel 19. However, the configuration of the second channel-forming part is not limited to the above-mentioned one, provided that the passage is formed at least along the tapering surface which surrounds the circumference of the discharge port 16. The contracting portion 7, the throat portion 8 (narrower portion), the flaring portion 9 and the outlet port 22 (outlet portion) are formed in the main body 1, so that the outlet channel 5 extends from the contracting portion 7 to the outlet port 22. However, the third channel-forming part is not limited to the above-mentioned one. Namely, although the first inlet channel 3, the second inlet channel 4 and the outlet channel 5 are formed by the main body 1 and the nozzle member 2, these channels 3 to 5 may also be formed by other members. The contracting portion 7 contracting in a tapered manner is formed in the main body 1, the protruding portion 14 protruding in a tapered manner is formed on the nozzle member 2, and these two are fitted with each other. However, the configurations of the main body 1 and the nozzle member 2 are not limited to the above-mentioned ones.

In the above embodiments, a plurality of groove portions 12, 25 to 29, 12*b* and 26*b* are formed on the opposed surfaces of the main body 1 and the nozzle member 2 in the circumferential direction, or the whirler 30 is provided in the first inlet channel 3 of the nozzle member 2 in order to generate a whirling stream. However, a whirling stream-generating part is not limited to the above-mentioned types. The groove portions may be provided on both of the inner circumferential surface of the contracting portion 7 (concave portion) of the main body 1 and the outer circumferential surface of the protruding portion 14 (convex portion) of the nozzle member 2, and a plurality of groove portions may be provided on both of the end surface 23 of the main body 1 and the end surface 24 of the nozzle member 2. Further, a plurality of groove portions may be formed on both of the inner circumferential surface of the contracting portion 7 and the outer circumferential surface of the protruding portion 14, and on both of the end surfaces 23 and 24. Namely, the present invention is not limited to the in-line-type fluid mixers according to the embodiments, provided that the features and functions of the invention can be realized.

According to the in-line-type fluid mixer of the present invention, the following effects are provided.

(1) Since the fluid introduced through either the first inlet channel or the second inlet channel turns into a whirling stream, the fluids that have joined together are effectively mixed and stirred. Therefore, there is no need to provide a separate stationary mixer in the downstream side, and the configuration of a compact size and at low cost can be realized.

(2) The whirling stream flows along the inner wall surface of the Venturi tube and the inner wall of piping in the downstream side of the Venturi tube. The flow serves as a protection layer under a condition where cavitation occurs and, at the same time, bubbles produced by the cavitation phenomenon are gathered to the vicinity of the center of the piping. Therefore, the inner wall of the piping is prevented from being damaged.

LIST OF REFERENCE NUMERALS

1 main body
2 nozzle member
3 first inlet channel
4 second inlet channel
5 outlet channel
6 receiving portion
7 contracting portion
8 throat portion
9 flaring portion
10 circular ring groove portion
11 internally threaded portion
12, 12*b* groove portions
13 cylindrical portion
14 protruding portion
15 externally threaded portion
16 discharge port
17 tapered portion
18 communication channel
19 annular channel
20 first inlet port
21 second inlet port
22 outlet port
23 bottom surface
24 end surface
25 groove portion
26, 26*b* groove portions
27 outer circumferential groove portion
28 spiral groove portion
29 spiral groove portion
30 whirler
31 intermediate portion
32*a* cylindrical portion
32*b* connecting portion
34 casing portion
36 channel portion
37 whirling portion
38 flat portion

The invention claimed is:

1. An in-line-type fluid mixer comprising:

a nozzle member having a first inlet portion and a first passage portion extending in a lengthwise direction, said nozzle member defining a first inlet channel from said first inlet portion and over said first passage portion; and a main body having a second inlet portion and a second passage portion extending along a tapered surface that surrounds a periphery of said first passage portion, said main body defining a second inlet channel from said second inlet portion and over said second passage portion, said main body having a narrower portion, a flaring portion and an outlet portion, said main body defining an outlet channel having a sectional area that increases from said narrower portion through said flaring portion to said outlet portion and being communicated with said first inlet channel and said second inlet channel, respectively, at an end of said narrower portion, wherein said nozzle member comprises a protruding portion which is situated at one end of said first inlet channel and has a substantially circular truncated cone shape, a first cylindrical portion situated at the other end of said first inlet channel, and a substantially cylindrical intermediate portion which is situated between the protruding portion and the first cylindrical portion and has an outer diameter smaller than that of the first cylindrical portion and that of the protruding portion at the upstream end, wherein said main body comprises a casing portion having a second cylindrical portion and a connecting portion protruding from a side surface of the second cylindrical portion and provided with the second inlet portion at an end thereof, and a channel portion having a concave portion which has a circular truncated cone shape and defines the tapered surface at an end of the channel portion closer to the nozzle member, the channel portion defining the outlet channel therein, wherein the second inlet channel defines an annular channel extending between the main body and the nozzle member which face each other, and a communication channel extending between the first cylindrical portion and the concave portion, when the protruding portion is fitted to the concave portion, wherein a plurality of groove portions are arranged in a circumferential direction on at least one of an inner circumferential surface of the concave portion and an outer circumferential surface of the protruding portion so as to generate a whirling stream therethrough, the plurality of groove portions extending from an upstream end to an intermediate position of at least one of the concave portion and the protruding portion, wherein a flat portion is annularly arranged in the downstream of the plurality of groove portions, the flat portion extending between the inner circumferential surface of the concave portion and the outer circumferential surface of the protruding portion, wherein the concave portion and the protruding portion are configured such that, when the protruding portion is fitted to the concave portion, the groove portions of the concave portion or the inner circumferential surface of a portion of the concave portion which faces the groove portions and the groove portions of the protruding portion or the outer circumferential surface of a portion of the protruding portion which faces the groove portions have the same angle of inclination as each other, and come at least partly in contact with each other, wherein an upstream end surface of the concave portion and an upstream end surface of the protruding portion are situated substantially on the same plane, and wherein a downstream edge of said concave portion and a downstream end surface of said protruding portion are situated substantially on the same plane.

2. The in-line-type fluid mixer according to claim 1, wherein said groove portions extend on at least one of on the inner circumferential surface and the outer circumferential surface of the protruding portion and outward in a radial direction in a radially curved manner.

3. The in-line-type fluid mixer according to claim 1, wherein said groove portions extend along a straight line extending outward in a radial direction without intersecting a central axis of said first inlet channel.

4. The in-line-type fluid mixer according to claim 1, wherein said groove portions extend spirally on at least one of the inner circumferential surface of said concave portion and the outer circumferential surface of said protruding portion.

* * * * *